US010916370B2

(12) United States Patent
Kubani et al.

(10) Patent No.: US 10,916,370 B2
(45) Date of Patent: Feb. 9, 2021

(54) ENGINE ASSEMBLY WITH VIBRATION-ISOLATED IGNITION COIL APPARATUS

(71) Applicant: GM GLOBAL TECHNOLOGY OPERATIONS LLC, Detroit, MI (US)

(72) Inventors: Ronald J. Kubani, Highland, MI (US); Coburn C. Bland, Jr., Alanson, MI (US); Sean M. Whitaker, Grosse Ile, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 455 days.

(21) Appl. No.: 15/916,877

(22) Filed: Mar. 9, 2018

(65) Prior Publication Data

US 2019/0279814 A1 Sep. 12, 2019

(51) Int. Cl.

| | |
|---|---|
| ***F02P 3/00*** | (2006.01) |
| ***H01F 38/12*** | (2006.01) |
| ***F02P 3/055*** | (2006.01) |
| ***F02P 13/00*** | (2006.01) |
| *F02F 1/24* | (2006.01) |
| *H01T 13/08* | (2006.01) |
| *H01T 13/04* | (2006.01) |

(52) U.S. Cl.

CPC ..... *H01F 38/12* (2013.01); *F02P 3/055* (2013.01); *F02P 13/00* (2013.01); *F02F 1/242* (2013.01); *H01T 13/04* (2013.01); *H01T 13/08* (2013.01)

(58) Field of Classification Search

None

See application file for complete search history.

(56) References Cited

U.S. PATENT DOCUMENTS 6,005,464 A * 12/1999 Sakamaki ..... F02P 3/02 123/634

7,095,306 B2 * 8/2006 Kato ..... F02P 3/02 336/90

* cited by examiner

*Primary Examiner* — Stephen W Jackson

(74) *Attorney, Agent, or Firm* — Quinn IP Law

(57) ABSTRACT

An engine ignition coil assembly disclosed herein provides an ignition coil housing that may be mounted on an engine block assembly and that is isolated from engine vibrations. The engine ignition coil assembly comprises an ignition coil housing. The ignition coil housing contains an ignition coil apparatus. An electrical connector for the ignition coil apparatus is mounted to the ignition coil housing. An elastomeric boot supports the ignition coil housing and may be disposed on an engine block assembly such that ignition coil housing is spaced apart from the engine block assembly by the elastomeric boot. A single fastener extends through a fastener opening in the ignition coil housing parallel with the elastomeric boot. An elastomeric isolator is disposed on the ignition coil housing at the fastener opening around the single fastener. A proximal end of the single fastener may be fixed to the engine block assembly.

20 Claims, 6 Drawing Sheets

ENGINE ASSEMBLY WITH VIBRATION-ISOLATED IGNITION COIL APPARATUS

INTRODUCTION

The present disclosure relates to an engine ignition coil assembly with an ignition coil housing. On an internal combustion engine, an ignition coil housing is mounted to a component of an engine block assembly, such as a cylinder head. An electrical connector may be integrally mounted to the housing to provide electrical power from a power source to a transformer in the ignition coil housing, which powers a spark plug mounted on the engine block assembly.

SUMMARY

Electrical components, such as an electrical connector mounted to an ignition coil housing, may be sensitive to engine vibrations. An engine ignition coil assembly disclosed herein provides an ignition coil housing that may be mounted on an engine block assembly and that is isolated from engine vibrations. The engine ignition coil assembly comprises an ignition coil housing. The ignition coil housing contains an ignition coil apparatus. An electrical connector for the ignition coil apparatus is mounted to the ignition coil housing. An elastomeric boot supports the ignition coil housing. A single fastener extends through a fastener opening in the ignition coil housing parallel with the elastomeric boot. An elastomeric isolator is disposed on the ignition coil housing at the fastener opening around the single fastener. Accordingly, when the elastomeric boot is disposed on an engine block assembly the ignition coil housing may be spaced apart from the engine block assembly by the elastomeric boot and sandwiched between the ignition coil boot and the elastomeric isolator. The vibration paths from the engine block assembly to the ignition coil housing are limited to those through the elastomeric boot, or through the elastomeric isolator via the fastener.

The elastomeric boot and the elastomeric isolator may be sufficiently resiliently deformable to dampen engine vibrations and prevent excessive vibration of the electrical connector and ignition coil apparatus. Utilizing the elastomeric boot as a vibration isolator and utilizing a single fastener for the ignition coil housing may reduce component count, reduce mass, and conform with packaging space limitations.

The engine block assembly may define a spark plug opening, and the elastomeric boot may have a through hole aligned with the spark plug opening. The engine block assembly may have a raised lip surrounding the spark plug opening, and the elastomeric boot may be seated on the raised lip with the raised lip extending into a groove of the elastomeric boot.

The single fastener and the fastener opening in the ignition coil housing may be configured such that the single fastener is able to translate relative to the ignition coil housing in the fastener opening, such as, for example, when an engine block assembly on which the elastomeric boot is mounted and to which a proximal end of the single fastener is fixed vibrates. The elastomeric boot may be supported on and the single fastener fixed to at least one of a cylinder head, a cam cover, or a rocker cover of the engine assembly. Stated differently, the single fastener is able to move relative to the ignition coil housing in the fastener opening when the engine assembly vibrates, and the isolator is able to dampen the movement.

In still another aspect, the elastomeric boot may extend laterally to the fastener opening in the ignition coil housing, and the elastomeric boot may have a fastener opening aligned with the fastener opening in the ignition coil housing. The single fastener may extend through both the fastener opening in the ignition coil housing and the fastener opening in the elastomeric boot. The elastomeric boot thus supports the ignition coil housing at the fastener opening as well as at the spark plug opening, and the fastener extends through the fastener opening in the elastomeric boot rather than spanning a gap.

The electrical connector may be supported by and extend through an opening in a side wall of the ignition coil housing orthogonal to a center axis of a through hole of the elastomeric boot.

The engine assembly may include a sleeve that is disposed in the fastener opening and is configured to limit compression of the ignition coil housing at the fastener opening. The sleeve may have a sleeve opening, and the fastener may be configured to translate relative to the ignition coil housing in the sleeve opening.

In one or more aspects, the single fastener may be configured to span a gap between the ignition coil housing and the engine block assembly. For example, the elastomeric boot may space the ignition coil housing away from the engine block assembly by a gap, and the single fastener may span the gap. A shoulder of the single fastener may abut the engine block assembly. Alternatively, a flange of the single fastener may abut the engine block assembly adjacent to the proximal end of the single fastener, and a height of the elastomeric boot between the engine block assembly and the ignition coil housing may be larger than a height of the flange of the single fastener such that the ignition coil housing is displaced from the flange of the single fastener along a longitudinal axis of the single fastener. A distal end of the single fastener may be configured to extend beyond the ignition coil housing opposite to the engine block assembly, and a cap nut may be configured to fit to the distal end of the single fastener with the elastomeric isolator between the cap nut and the ignition coil housing.

In one aspect, an engine assembly comprises an ignition coil housing having an internal cavity and a first housing wall with a coil opening. An ignition coil apparatus is configured to be disposed in the internal cavity. An engine block assembly has a spark plug opening. An elastomeric boot is configured to be mounted to the engine block assembly at the spark plug opening and has a through hole. The ignition coil housing is configured to be mounted on the elastomeric boot with an output terminal of the ignition coil apparatus extending through the ignition coil opening and the through hole and operatively connected to a spark plug mounted to the engine block assembly in the spark plug opening. The ignition coil housing has a fastener opening extending parallel with the through hole. A fastener is configured to extend through the fastener opening and secure to the engine block assembly. The ignition coil housing and the engine block assembly are configured such that the ignition coil housing is entirely displaced from the engine block assembly by the elastomeric boot. An elastomeric isolator is configured to support the fastener at a second housing wall of the ignition coil housing opposite to the first housing wall such that the elastomeric boot and the elastomeric isolator isolate the ignition coil housing from vibrations of the engine block assembly.

In one aspect, an electrical connector is supported by and extends through the ignition coil housing. The electrical connector may include an input terminal connected to the ignition coil apparatus for supplying power to the ignition coil apparatus.

The above features and advantages and other features and advantages of the present disclosure are readily apparent from the following detailed description of the best modes for carrying out the disclosure when taken in connection with the accompanying drawings.

DETAILED DESCRIPTION

Figure 1:
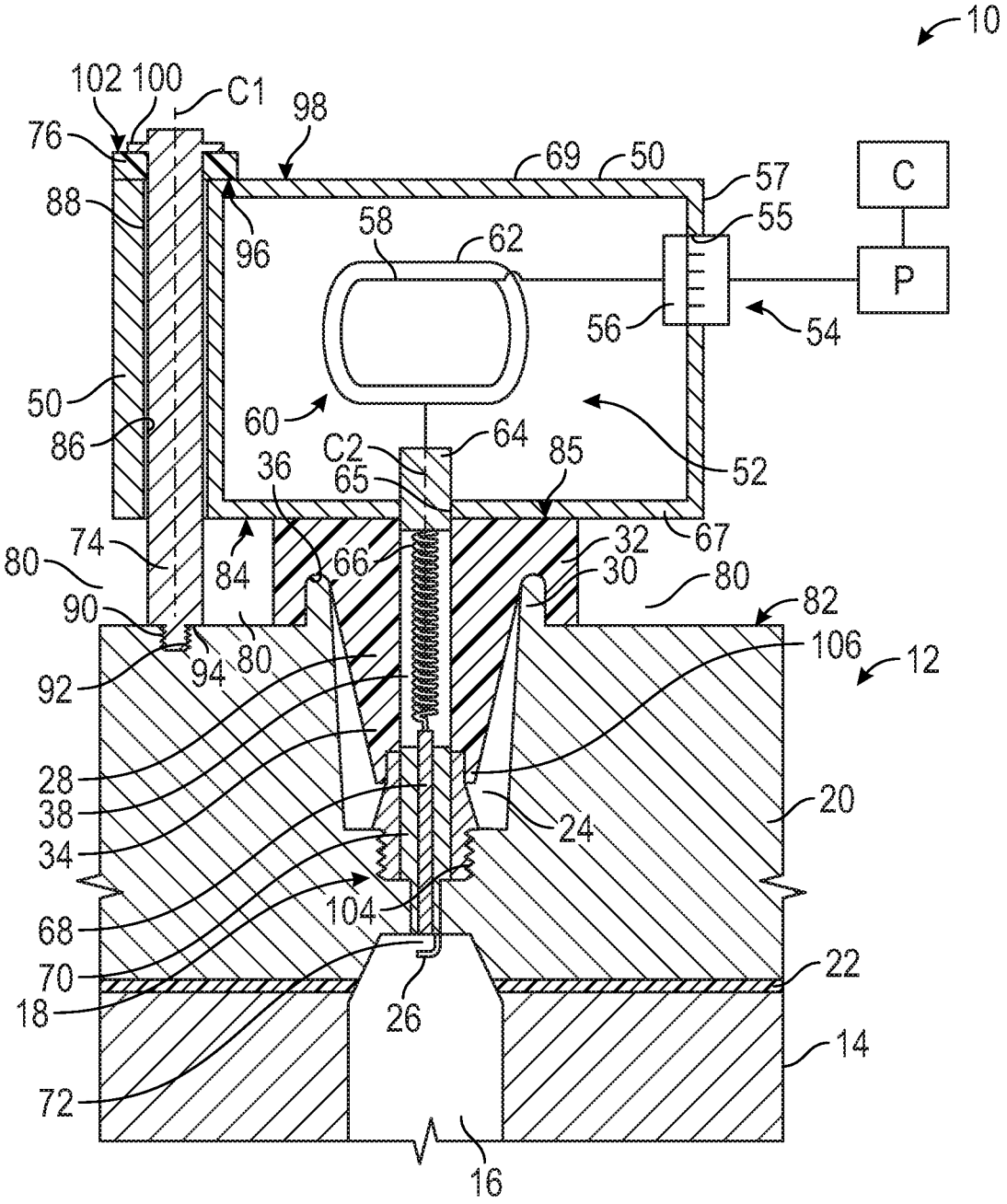
FIG. 1 is a fragmentary cross-sectional view of an engine assembly with an engine ignition coil assembly including an ignition coil apparatus.

Referring to the drawings, wherein like reference numbers refer to like components, FIG. 1 shows an engine assembly such as for a vehicle, including an automotive vehicle or a nonautomotive vehicle. The vehicle may be autonomous or driven by a human, and may include, but not be limited to a mobile platform in the form of a commercial vehicle (car, truck, sport utility vehicle, etc.), industrial vehicle (bus, etc.), agricultural vehicle, passenger vehicle, aircraft, watercraft, train, all-terrain vehicle, personal movement apparatus, robot and the like to accomplish the purposes of this disclosure. Still further, the engine assembly 10 could be for a non-vehicle application.

The engine assembly 10 is a combustion engine that uses spark ignition. The engine assembly 10 includes an engine block assembly 12 that has an engine block 14 that defines combustion cylinders 16 (one shown). A spark plug 18 is supported by another engine component of the engine block assembly 12, such as a cylinder head, a cam cover, or a rocker cover. As shown, the engine component will be referred to as a cylinder head 20. A gasket 22 may help seal the interface between the engine block 14 and the cylinder head 20.

The cylinder head 20 has a spark plug opening 24 at which the spark plug 18 is supported so that a spark plug tip 26 extends into the combustion cylinder 16. An elastomeric boot 28 is disposed on the engine block assembly 12 where it is seated on a raised lip 30 of the cylinder head 20 such that it is supported by the cylinder head 20. The raised lip 30 and the elastomeric boot 28 surround the spark plug opening 24. More specifically, a flange 32 of the elastomeric boot 28 surrounds the raised lip 30. A central portion 34 of the elastomeric boot 28 extends down into the spark plug opening 24. The raised lip 30 extends into a groove 36 between the flange 32 and the central portion 34 that is configured to receive the raised lip 30. For example, the raised lip 30 and the groove 36 may be an annular. Accordingly, the elastomeric boot 28 is configured to be mounted to the engine block assembly 12 at the spark plug opening 24. The elastomeric boot 28 has a through hole 38 aligned with the spark plug opening 24.

The engine assembly 10 includes an ignition coil housing 50 that contains an ignition coil apparatus 52. An electrical connector 54 for the ignition coil apparatus 52 is integral with and mounted to the ignition coil housing 50. More specifically, the integral electrical connector 54 is supported by and extends through an opening 55 in a sidewall 57 of the of the ignition coil housing 50 orthogonal to a center axis C2 of the through hole 38 of the elastomeric boot 28. The electrical connector 54 includes a relatively low voltage input terminal 56 connected to the ignition coil apparatus 52 for supplying power to a primary winding 58 of a transformer 60. For example, a controller C may control a power source P such as a battery to provide electrical power to the transformer 60 through the input terminal 56. The input terminal 56 may include a plurality of pins that mate to an external portion of the electrical connector 54. The transformer 60 includes the primary winding 58 and a secondary winding 62, both wound around an iron core (not shown). The secondary winding 62 has a greater number of turns than the primary winding 58, so that a relatively high voltage is induced in the secondary winding 62 when the current supplied to the primary winding 58 is interrupted, such as via a solid state switch in the controller C. An output terminal 64 extends through an ignition coil opening 65 in a first housing wall 67 (i.e., the bottom housing wall) and connects the secondary winding 62 with a conductive spring 66 which in turn connects to an electrode 68 that extends through an insulator 70.

The timing of the change in current via the solid state switch controls the voltage to the electrode 68. The voltage at the electrode 68 spans a gap 72 to the spark plug tip 26, causing a spark that ignites fuel in the cylinder 16. Engine vibration occurs due to the forces generated by the combustion process. The integrity of the relatively small components of the electrical connector 54 and the ignition coil apparatus 52 is best preserved when these components are isolated from the engine vibrations. Accordingly, the ignition coil housing 50, the elastomeric boot 28, a fastener 74, and an elastomeric isolator 76 on the fastener 74 may be referred to as an engine ignition coil assembly and are configured to isolate the ignition coil housing 50 and the electrical components connected thereto from engine vibration.

Figure 2:
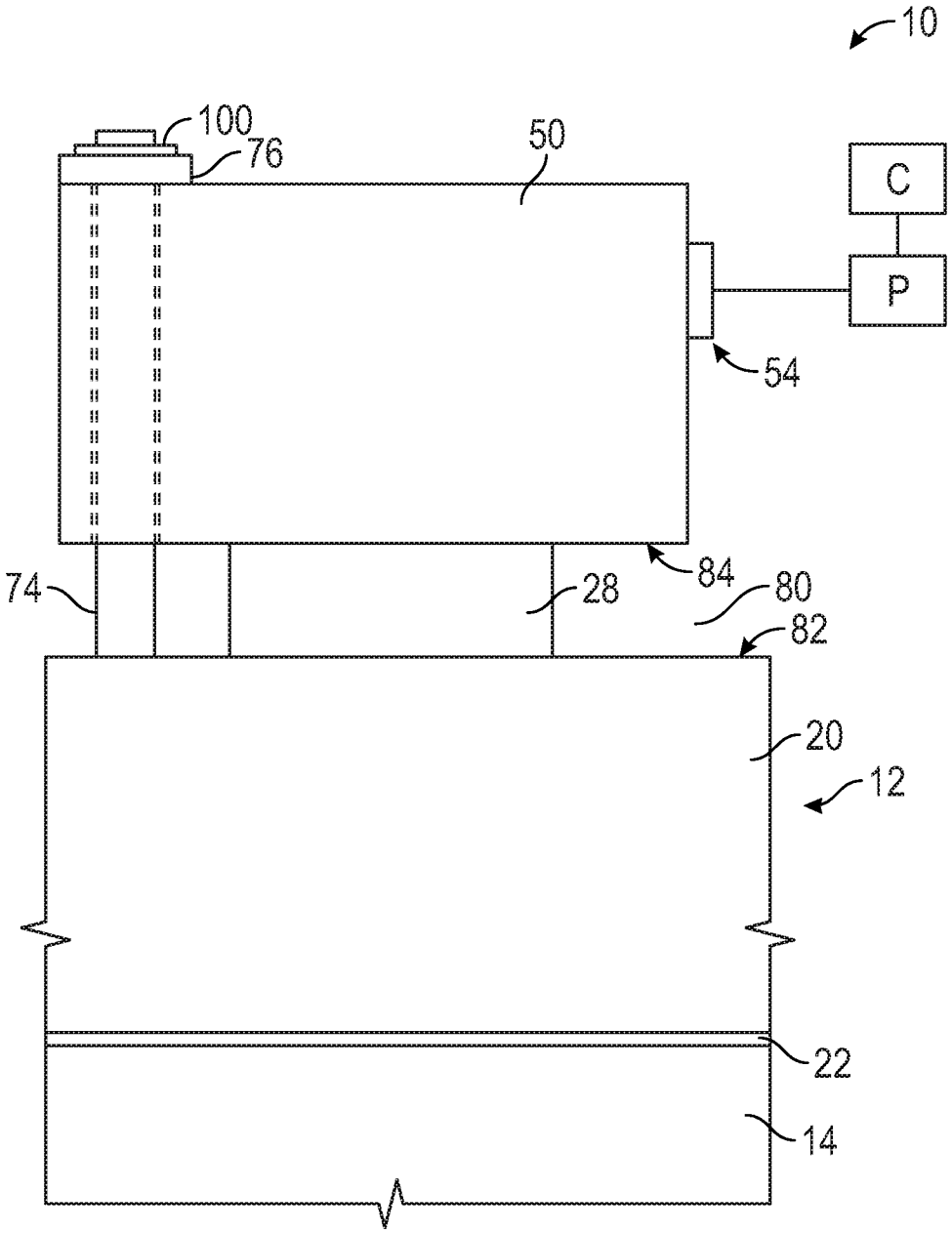
FIG. 2 is a side view of the engine assembly of FIG. 1.

First, the ignition coil housing 50 is configured so it is not in contact with the engine block assembly 12. Instead, a lower (proximal) surface 84 of the ignition coil housing 50 is supported on an upper (distal) surface 85 of the elastomeric boot 28 such that the ignition coil housing 50 is spaced apart from the engine block assembly 12 by the elastomeric boot 28. In FIGS. 1 and 2, a gap 80 is shown between the exterior surface 82 of the cylinder head 20 and a lower (proximal) surface 84 of the ignition coil housing 50. The exterior surface 82 and the lower surface 84 are represented as planar so that the resulting gap 80 is of uniform height. However, the surfaces 82, 84 may be non-planar, with a non-uniform resulting gap 80, as long as the surfaces 82, 84 are not in contact with one another such that the ignition coil housing 50 is entirely displaced from the engine block assembly 12 by the elastomeric boot 28.

In addition to the boot 28 supporting the ignition coil housing 50, the ignition coil housing 50 is fastened to the engine block assembly 12 by a single fastener 74. Stated differently, there is an absence of additional fasteners connecting the ignition coil housing 50 to the engine block assembly 12. The single fastener 74 extends through a fastener opening 86 in the ignition coil housing 50. The single fastener 74 has a longitudinal axis C1 parallel with a central axis C2 of the elastomeric boot 28 through the through hole 38 of the elastomeric boot 28. The fastener opening 86 is wider than the single fastener 74. For example, both may be circular in a cross-section taken along a center axis of the single fastener 74, orthogonal to view of FIG. 1, with the diameter of the single fastener 74 less than a diameter of the opening 86 such that a clearance 88 exists between the single fastener 74 and the coil housing 50 in the fastener opening 86.

A threaded proximal end 90 of the single fastener 74 is fixed to the engine block assembly 12 by threading into a threaded fastener opening 92 in the cylinder head 20. The single fastener 74 is wider in diameter adjacent the threaded proximal end 90 so that a shoulder 94 of the single fastener 74 rests on the surface 82 of the cylinder head 20.

The elastomeric isolator 76 is disposed on a second housing wall 69 (i.e., a distal wall, also referred to as an upper wall) of the ignition coil housing 50 at the fastener opening 86 around the single fastener 74. For example, the elastomeric isolator 76 may be an annular construction having a lower (proximal) surface 96 disposed in contact with an upper (distal) surface 98 of the ignition coil housing 50. The second housing wall 69 is opposite to the first housing wall 67. A fastener head 100 of the single fastener 74 abuts an upper (distal) surface 102 of the elastomeric isolator 76 such that the isolator 76 supports the single fastener 74 at the second housing wall 69. After threading the spark plug 18 into a threaded portion 104 of the cylinder head 20 at the spark plug opening 24, a lower portion 106 of the elastomeric boot 28 is fit over the spark plug 18 and the lip 30 is placed in the groove 36. The ignition coil housing 50 is mounted on the elastomeric boot 28 with the high voltage terminal 64 extending into the through hole 38 and connected with the spring 66. The ignition coil housing 50 is positioned on the elastomeric boot 28 so that the fastener opening 86 aligns with the threaded opening 92. The isolator 76 is placed on the surface 98 at the fastener opening 86 or is already situated around the fastener 74 under the head 100. The single fastener 74 is then slid through the fastener opening 86 and the threaded end 90 is threaded to the cylinder head 20.

The combined height of the isolator 76, the ignition coil housing 50, and the elastomeric boot 28 from the distal surface 85 to the bottom of the flange 32 may be slightly greater than or equal to the height of the single fastener 74 from the underside of the head 100 to the shoulder 94 so that the elastomeric boot 28 and the isolator 76 are slightly compressed when the single fastener 74 is threaded into the fastener opening 92. Accordingly, the ignition coil housing 50 is spaced apart from (i.e., not in contact with) the engine block assembly 12, and is sandwiched between the elastomeric boot 28 and the elastomeric isolator 76. The vibration paths from the engine block assembly 12 to the ignition coil housing 50 are limited to a path through the elastomeric boot 28, and a path through the elastomeric isolator 76 via the single fastener 74. The elastomeric boot 28 and the elastomeric isolator 76 are natural rubber or another resiliently deformable material with a greater elastic deformability than that of the ignition coil housing 50, which is plastic or metal, and than that of the single fastener 74 (which is steel). The elastomeric boot 28 and the elastomeric isolator 76 are resiliently deformable to dampen engine vibrations and prevent excessive vibration of the electrical connector 54 and the ignition coil apparatus 52. During engine vibration, because the fastener opening 86 is wider than the single fastener 74 by the clearance 88, the single fastener 74 can translate along its longitudinal center axis in the fastener opening 86 relative to the ignition coil housing 50, moving with the cylinder head 20 and its vibrations, but not transferring vibrations to the ignition coil housing 50 due to the elastomeric boot 28 and the elastomeric isolator 76.

Figure 3:
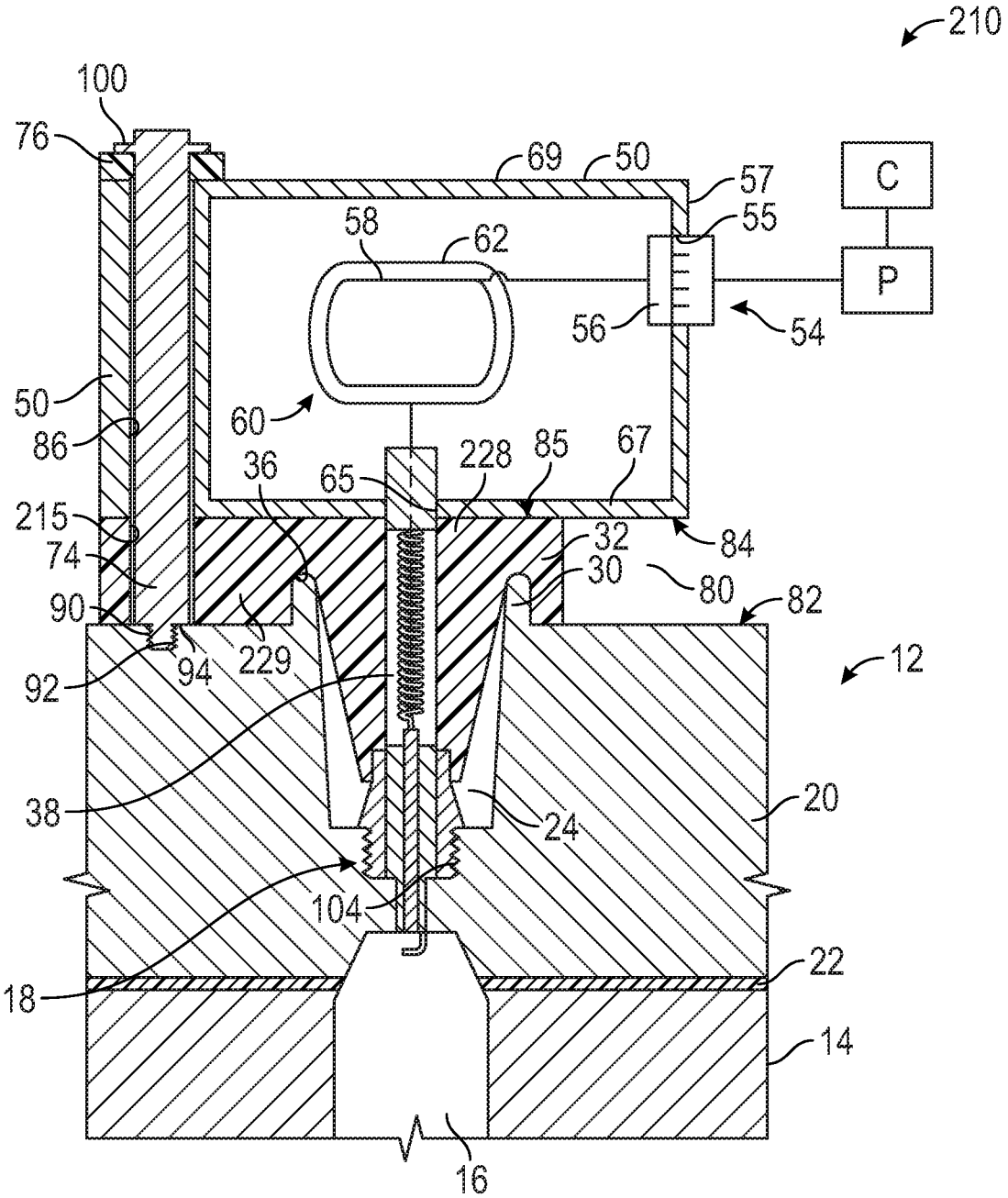
FIG. 3 is a fragmentary cross-sectional view of an alternative engine assembly with an engine ignition coil assembly including an ignition coil apparatus.

FIG. 3 shows another engine assembly 210 that is the same as described with respect to engine assembly 10 except that the elastomeric boot 28 is replaced with an elastomeric boot 228 that includes a side portion 229 that extends laterally from the through hole 38 to the threaded fastener opening 92 in the cylinder head 20. The single fastener 74 thus extends both through the fastener opening 86 in the ignition coil housing 50, through a fastener opening 215 in the elastomeric boot 228, and into the fastener opening 92 in the cylinder head 20. The gap 80 of the engine assembly 10 between the elastomeric boot 28 and the single fastener 74 of FIG. 1 is filled by the side portion 229 in the engine assembly 210. A greater area of the lower surface 84 of the ignition coil housing 50 is thus in contact with and is supported by the elastomeric boot 228, which may help to further isolate the ignition coil housing 50 from engine vibrations. Like components are indicated with like reference numbers and function as described with respect to the engine assembly 10.

Figure 4:
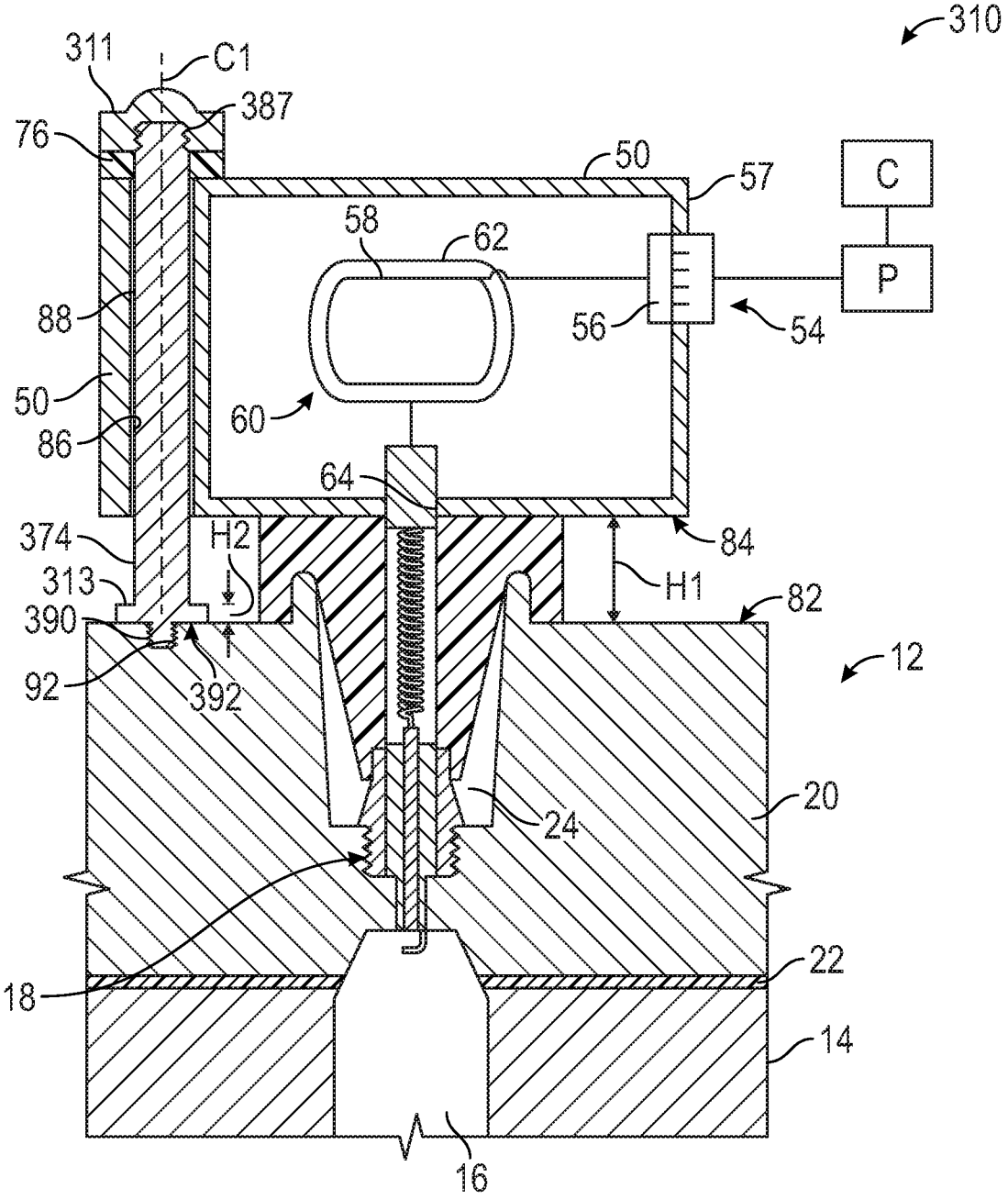
FIG. 4 is a fragmentary cross-sectional view of an alternative engine assembly with an engine ignition coil assembly including an ignition coil apparatus.
Figure 6:
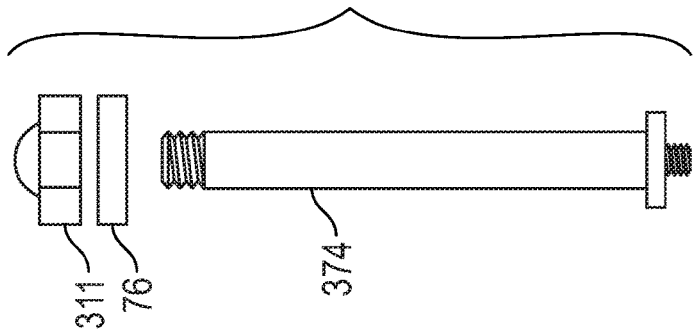
FIG. 6 is an exploded view of a fastener, cap nut, and isolator of the engine assembly of FIG. 5.
Figure 5:
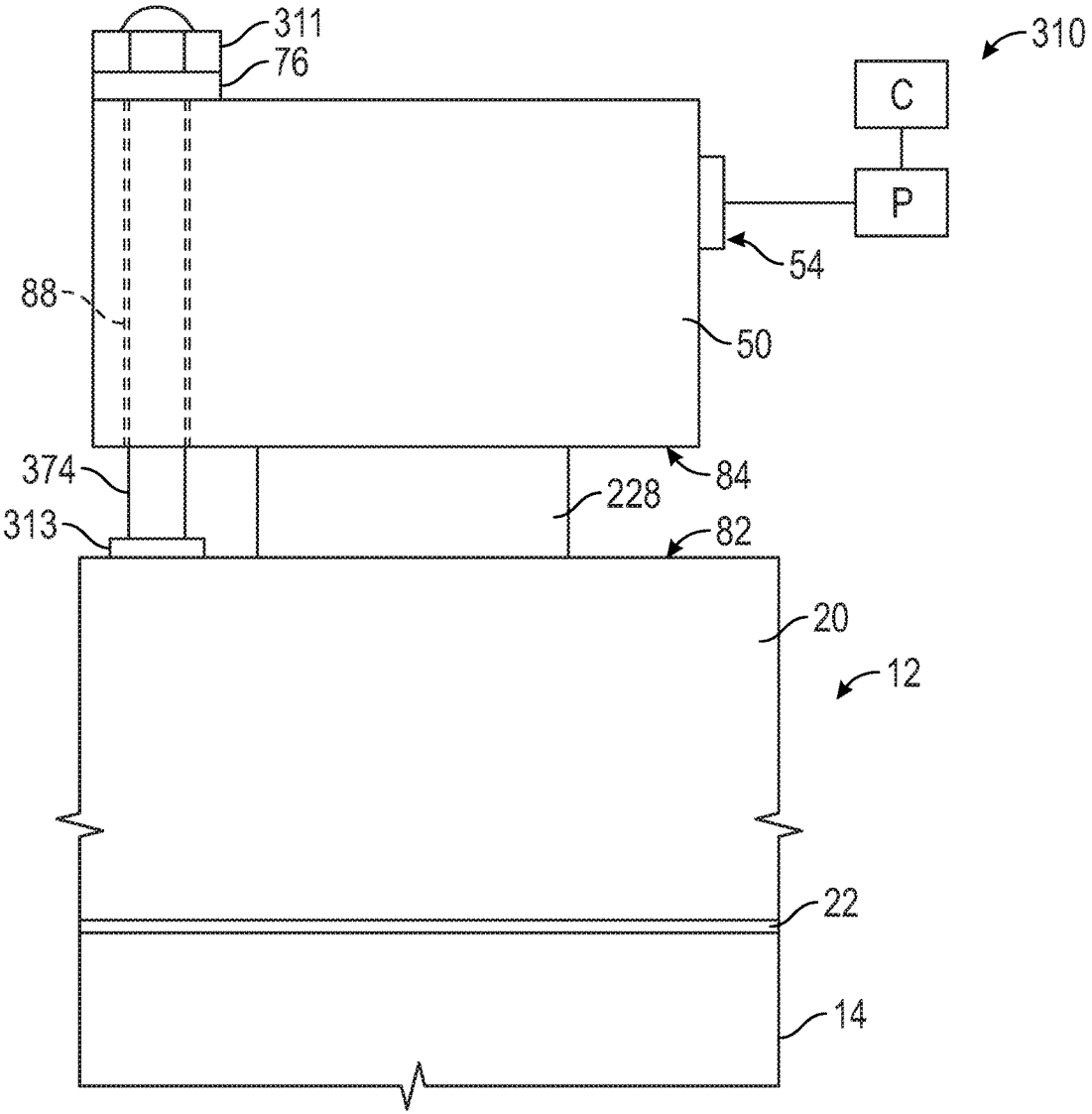
FIG. 5 is a side view of the engine assembly of FIG. 4.

FIGS. 4-5 show another engine assembly 310 that is alike in all aspects to the engine assembly 10 except that the single fastener 74 is replaced with a single fastener 374 and a cap nut 311. The single fastener 374, cap nut 311, and isolator 76 are shown in exploded view in FIG. 6. A flange 313 of the single fastener 374 abuts the surface 82 of the cylinder head 20 adjacent to a threaded proximal end 390 of the single fastener 374. A height H1 of the elastomeric boot 28 between the engine block assembly 12 and the ignition coil housing 50 is larger than a height H2 of the flange 313 of the single fastener 374 such that the ignition coil housing 50 is displaced from the flange 313 of the single fastener along a longitudinal axis C1 of the single fastener 374. The single fastener 374 is sufficiently long such that a threaded distal end 387 of the single fastener 374 extends beyond the ignition coil housing 50 opposite to the engine block assembly 12. State differently, the threaded distal end 387 extends beyond the distal surface 102 of the isolator 76 when the threaded end 390 is secured in the fastener opening 92. The area of the surface 392 of the flange 313 is larger than the area of the surface of the shoulder 94 in FIG. 1, lending stability to the single fastener 374 if it is secured first to the cylinder head 20, and then the coil housing 50 is placed on the elastomeric boot 28 and over the single fastener 374. Next, the isolator 76 is placed over the distal end of the single fastener 374. The cap nut 311 has internal threads that are then threaded to the threaded distal end 387 of the single fastener 374, with the elastomeric isolator 76 between the cap nut 311 and the ignition coil housing 50. Like components are indicated with like reference numbers and function as described with respect to the engine assembly 10.

Figure 7:
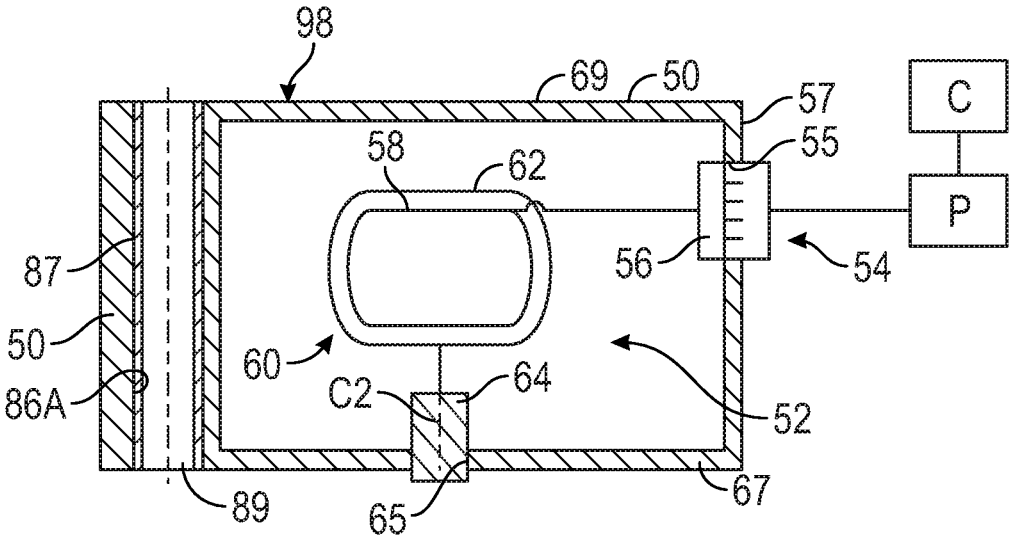
FIG. 7 is a schematic illustration of an alternative embodiment of an ignition coil housing including a compression-limiting sleeve at a fastener opening in the ignition coil housing.

FIG. 7 shows the ignition coil housing 50 with a slightly larger fastener opening 86A than fastener opening 86, and with a sleeve 87 disposed in the fastener opening 86A. The fastener opening 86A extends entirely through the coil housing 50 from the first housing wall 67 to the second housing wall 69. The sleeve 87 is a tubular structure with a longitudinal center axis coincident with the longitudinal center axis of the fastener opening 86A. Like the fastener opening 86A, the sleeve 87 has a sleeve opening 89 that extends through the sleeve 87. The sleeve opening 89 is sufficiently large that a clearance similar to clearance 88 exists between the single fastener 74 or 374 and the inner surface of the sleeve 87, so that the single fastener 74 or 374 translates along its longitudinal center axis relative to the ignition coil housing 50 in the sleeve opening 89 when the engine block assembly vibrates. The sleeve 87 may be steel or another material harder than the ignition coil housing 50 so that the sleeve is configured to limit compression of the ignition coil housing 50 at the fastener opening 86A (i.e., limit inward compression of the ignition coil housing in a direction along the length of the fastener opening 86A). The sleeve 87 may be secured to the ignition coil housing 50 by overmolding the ignition coil housing 50 to the sleeve 87.

While the best modes for carrying out the disclosure have been described in detail, those familiar with the art to which this disclosure relates will recognize various alternative designs and embodiments for practicing the disclosure within the scope of the appended claims.

What is claimed is:

1. An engine ignition coil assembly in combination with an engine block assembly, comprising:

an ignition coil housing containing an ignition coil apparatus and with an electrical connector for the ignition coil apparatus mounted to the ignition coil housing;

an elastomeric boot supporting the ignition coil housing;

a single fastener extending through a fastener opening in the ignition coil housing parallel with the elastomeric boot; and an elastomeric isolator disposed on the ignition coil housing at the fastener opening around the single fastener; wherein the elastomeric boot and the elastomeric isolator are configured to isolate the ignition coil housing from vibrations;

wherein the elastomeric boot is disposed on the engine block assembly and the ignition coil housing is spaced apart from the engine block assembly by the elastomeric boot to isolate vibrations of the engine block assembly from the ignition coil housing; and wherein the single fastener has a proximal end fixed to the engine block assembly and is configured to span a gap between the ignition coil housing and the engine block assembly.

2. The engine ignition coil assembly and engine block assembly of claim 1, wherein the single fastener and the fastener opening are configured such that the single fastener is translatable relative to the ignition coil housing in the fastener opening.

3. An engine ignition coil assembly in combination with an engine block assembly, comprising:

an ignition coil housing containing an ignition coil apparatus and with an electrical connector for the ignition coil apparatus mounted to the ignition coil housing;

an elastomeric boot supporting the ignition coil housing;

a single fastener extending through a fastener opening in the ignition coil housing parallel with the elastomeric boot; and an elastomeric isolator disposed on the ignition coil housing at the fastener opening around the single fastener; wherein the elastomeric boot and the elastomeric isolator are configured to isolate the ignition coil housing from vibrations;

wherein a flange of the single fastener abuts the engine block assembly adjacent to a proximal end of the single fastener; and wherein a height of the elastomeric boot between the engine block assembly and the ignition coil housing is larger than a height of the flange of the single fastener such that the ignition coil housing is displaced from the flange of the single fastener along a longitudinal axis of the single fastener.

4. The engine ignition coil assembly and engine block assembly of claim 1, wherein:

the electrical connector is supported by and extends through an opening in a side wall of the ignition coil housing orthogonal to a center axis of a through hole of the elastomeric boot.

5. The engine ignition coil assembly and engine block assembly of claim 1, further comprising:

a sleeve disposed in the fastener opening and configured to limit compression of the ignition coil housing at the fastener opening; and wherein the sleeve has a sleeve opening, and the fastener is configured to translate relative to the ignition coil housing in the sleeve opening.

6. The engine ignition coil assembly and engine block assembly of claim 1, wherein a shoulder of the single fastener abuts the engine block assembly.

7. The engine ignition coil assembly and engine block assembly of claim 1, wherein:

the engine block assembly defines a spark plug opening;

the elastomeric boot has a through hole aligned with the spark plug opening;

the engine block assembly has a raised lip surrounding the spark plug opening; and the elastomeric boot is seated on the raised lip with the raised lip extending into a groove of the elastomeric boot.

8. The engine ignition coil assembly and engine block assembly of claim 3, wherein:

the elastomeric boot extends laterally to the fastener opening in the ignition coil housing, and has a fastener opening aligned with the fastener opening in the ignition coil housing; and the single fastener extends through both the fastener opening in the ignition coil housing and the fastener opening in the elastomeric boot.

9. The engine ignition coil assembly and engine block assembly of claim 3, wherein a distal end of the single fastener is configured to extend beyond the ignition coil housing opposite to the engine block assembly; and the engine ignition coil assembly further comprising:

a cap nut configured to fit to the distal end of the single fastener with the elastomeric isolator between the cap nut and the ignition coil housing.

10. An engine assembly comprising:

an ignition coil housing having an internal cavity and a first housing wall with an ignition coil opening;

an ignition coil apparatus configured to be disposed in the internal cavity;

an engine block assembly having a spark plug opening;

an elastomeric boot configured to be mounted to the engine block assembly at the spark plug opening and having a through hole;

wherein the ignition coil housing is configured to be mounted on the elastomeric boot with an output terminal of the ignition coil apparatus extending through the ignition coil opening and the through hole and operatively connected to a spark plug mounted to the engine block assembly in the spark plug opening;

wherein the ignition coil housing has a fastener opening extending parallel with the through hole;

a fastener configured to extend through the fastener opening and secure to the engine block assembly;

wherein the ignition coil housing and the engine block assembly are configured such that the ignition coil housing is entirely displaced from the engine block assembly by the elastomeric boot; and an elastomeric isolator configured to support the fastener at a second housing wall of the ignition coil housing opposite to the first housing wall such that the elastomeric boot and the elastomeric isolator isolate the ignition coil housing from vibrations of the engine block assembly.

11. The engine assembly of claim 10, wherein the fastener is configured to translate relative to the ignition coil housing in the fastener opening when the engine block assembly vibrates.

12. The engine assembly of claim 10, wherein the fastener is configured to span a gap between the ignition coil housing and the engine block assembly.

13. The engine assembly of claim 10, wherein a shoulder of the fastener abuts the engine block assembly when the fastener is secured to the engine block assembly at a fastener opening in the engine block assembly.

14. The engine assembly of claim 10, wherein:

the engine block assembly has a lip surrounding the spark plug opening and extending toward the ignition coil housing; and the elastomeric boot has a groove configured to receive the lip.

15. The engine assembly of claim 10, wherein:

the elastomeric boot extends laterally from the through hole to the fastener opening in the ignition coil housing; and the fastener is configured to extend through both the fastener opening in the ignition coil housing and through a fastener opening in the elastomeric boot.

16. The engine assembly of claim 10, wherein:

a flange of the fastener abuts the engine block assembly when a proximal end of the fastener is secured to the engine block assembly at a fastener opening in the engine block assembly; and the ignition coil housing is spaced apart from the flange of the fastener along a longitudinal axis of the fastener.

17. The engine assembly of claim 16, wherein a distal end of the fastener is configured to extend beyond the ignition coil housing opposite of the engine block assembly; and the engine assembly further comprising:

a cap nut configured to fit to the distal end of the fastener with the elastomeric isolator between the cap nut and the ignition coil housing.

18. The engine assembly of claim 10, further comprising:

an electrical connector supported by and extending through the ignition coil housing; wherein the electrical connector includes an input terminal connected to the ignition coil apparatus for supplying power to the ignition coil apparatus.

19. The engine assembly of claim 10, further comprising:

a sleeve disposed in the fastener opening and configured to limit compression of the ignition coil housing at the fastener opening;

wherein the sleeve has a sleeve opening, and the fastener is configured to translate relative to the ignition coil housing in the sleeve opening.

20. The engine ignition coil assembly and engine block assembly of claim 3, wherein the single fastener and the fastener opening are configured such that the single fastener is translatable relative to the ignition coil housing in the fastener opening.

* * * * *